US011898822B2

(12) United States Patent
Ortega

(10) Patent No.: US 11,898,822 B2
(45) Date of Patent: Feb. 13, 2024

(54) FIREARMS INSTRUMENTING SYSTEM INTEGRATING DISTINCT MEASUREMENTS THAT INFLUENCES THE BALLISTIC TRAJECTORY AND ITS CORRESPONDING DATA RETRIEVAL

(71) Applicants: Carlos Maria Ortega, Buenos Aires (AR); Giosue Martin Ponsiglione Rios, Buenos Aires (AR)

(72) Inventor: Carlos Maria Ortega, Buenos Aires (AR)

(73) Assignees: Carlos Maria Ortega, Buenos Aires (AR); Giosue Martín Ponsiglione Rios, Buenos Aires (AR), PART INTEREST ( * ) Notice: Subject to any disclaimer, the term of this patent is extended or adjusted under 35 U.S.C. 154(b) by 0 days.

(21) Appl. No.: 17/758,187

(22) PCT Filed: Jan. 3, 2020

(86) PCT No.: PCT/IB2020/050037
§ 371 (c)(1),
(2) Date: Jun. 29, 2022

(87) PCT Pub. No.: WO2021/136974
PCT Pub. Date: Jul. 8, 2021

(65) Prior Publication Data

US 2023/0058539 A1 Feb. 23, 2023

(51) Int. Cl.

| | |
|---|---|
| ***F41G 3/12*** | (2006.01) |
| ***F41A 21/32*** | (2006.01) |
| ***F41G 3/08*** | (2006.01) |

(52) U.S. Cl.
CPC ..... *F41G 3/12* (2013.01); *F41G 3/08* (2013.01); *F41A 21/325* (2013.01)

(58) Field of Classification Search
CPC ..... F41G 3/12; F41G 3/08; F41A 21/325
(Continued)

(56) References Cited

U.S. PATENT DOCUMENTS 9,010,002 B2 * 4/2015 Popa-Simil ..... F41A 25/00 42/1.06
9,574,843 B2 * 2/2017 Itz ..... F41A 21/32
(Continued)

FOREIGN PATENT DOCUMENTS

JP 2013195028 9/2013

*Primary Examiner* — Michael G Lee
*Assistant Examiner* — David Tardif
(74) *Attorney, Agent, or Firm* — Defillo & Associates, Inc.; Evelyn A. Defillo

(57) ABSTRACT

A measurement and data integration system for the preparation of a firearm, to fire an accurate, precise shot, incorporating a tubular component containing two sensors to measure the speed of the projectile, further including a subsystem for the detection of the impact thereof and the measurement of the time of flight of the same, a subsystem for the measurement of the angles of inclination and cant; a calibration subsystem, a subsystem for communication with weather stations which consults and receives in real time the meteorological variables, as well as a microprocessor with a first operational programme that measures, requests, stores and manages all the aforementioned signals, and a second programme that includes an interface with the user.

9 Claims, 10 Drawing Sheets

(58) Field of Classification Search
USPC ..... 235/417
See application file for complete search history.

(56) References Cited

U.S. PATENT DOCUMENTS

| | | | | |
|---|---|---|---|---|
| 9,709,593 | B1 * | 7/2017 | Sitzman | G01P 3/64 |
| 2003/0082502 | A1 | 5/2003 | Stender et al. | |
| 2015/0008260 | A1 * | 1/2015 | Volfson | F41G 3/08 235/404 |
| 2016/0069643 | A1 * | 3/2016 | Lyren | F41G 1/467 345/589 |
| 2023/0058539 | A1 * | 2/2023 | Ortega | F41G 3/06 |

* cited by examiner

FIREARMS INSTRUMENTING SYSTEM INTEGRATING DISTINCT MEASUREMENTS THAT INFLUENCES THE BALLISTIC TRAJECTORY AND ITS CORRESPONDING DATA RETRIEVAL

CROSS REFERENCE TO RELATED APPLICATION

This application is a national stage entry of PCT/162020/050037 filed Jan. 3, 2020, under the International Convention.

FIELD OF APPLICATION OF THE PRESENT INVENTION

The present invention finds its field of application in a device capable of measuring the aerodynamic, atmospheric, tilt, time-of-flight variables and solving the equations making use of said variables predicting the trajectory of a following round fired by a firearm.

In particular, without the following limiting or excluding its use in all types of weapons capable of firing a projectile, this device is preferably used to solve the shooting equations of all types of long barrel weapons, such as firearms, shoulder weapons, support weapons, rifles, submachine guns, short handguns or any type of weapon that uses ballistic concepts in general.

It is known that in target practice, very small variations in the velocity of the fired projectile can result in relatively large differences in the impact zone or target. This fact is accentuated when the target to hit is placed at a great distance, for example from 500 to 2,000 meters. Assuming a long barrel gun with its sights correctly aligned, that the propellant charge (powder) and the mass of the projectile are adequate, the factors determining the flight path of the projectile can be several, as follows:

a) the muzzle velocity of the projectile;
b) the ballistic coefficient, parameter par excellence calculated from the time de round leaves de gun's barrel;
c) the speed and direction of the prevailing wind in the trajectory of the projectile;
d) ambient humidity;
e) temperature and atmospheric pressure;
f) altitude above sea level;
g) the geographical position of the marksman in terms of latitude and longitude;
h) the variables of the two angles with respect to the barrel of the weapon: its angle of inclination and the edge angle.

PRIOR STATE OF THE ART

U.S. Pat. No. 9,574,843 issued to the firm MAGNETOSPEED LLC teaches how to detect the deviation of the projectile issuing from a portable weapon (rifle). This patent shows how linking the muzzle of the weapon with a trajectory correction device consisting of a tubular piece (20) inside which a ballistic chronograph (21) is located (See FIG. 2 of this patent U.S. Pat. No. 9,574,843) and a control circuit (22) with one or more windings (24) arranged at the outlet of this tubular piece. The velocity of the projectile obtained through the ballistic chronograph 2 is sent to the control circuit (22) wherein the appropriate impulse to impart to the projectile (25) is calculated. The pulse power supply (23) then discharges an appropriate amount of energy to the steering coils (24) whose magnetic fields impart a small amount of corrective kinetic energy to the projectile (25) as it passes through the steering coils (24) (with approximately a 10 μs to 30 us time window) by adjusting the paths energizing one or more drive coils (24). As criticism of this patent U.S. Pat. No. 9,574,843, it should be noted that the projectile velocity sensors (25) of the ballistic chronograph (21) are very close to the mouth of gun's barrel and practically the first sensor is very close to the second. In addition, no information is provided regarding the impact zone, trying a priori to correct the trajectory based on anemometric data fed to the control circuit.

Also known in the art is patent U.S. Pat. No. 9,709,593, issued to MAGNETOSPEED LLC. In this second patent, a sensor module (110) and a controller (116) are arranged at the mouth of the gun's barrel, but in an open configuration, that is, without the use of a tubular piece through which the speed of the projectile is measured. The sensor module (110) is made up of a pair of sensor coils (106, 108). On each of the sensor coils (106, 108) sequential voltages are produced which are transmitted to the controller (116) determining the speed of the projectile (104). An attenuated voltage is applied to a processor (300) containing an analogic comparator (340) to compare the voltage at a sensor signal jack and the threshold voltage (320). The voltage waves and their zero crossings are compared to determine the corrections to be imparted to the projectile by the magnetic field produced by the coils.

Inconveniencies Found in the Cited Prior Art

It is evident that in both above mentioned prior art embodiments not all the variables involved in the free trajectory of the projectile are measured or collected. Below is a list of all the omissions found in this prior art, whether this is due to the known prior art patents or to the variables that up to date are personally and subjectively estimated by each shooter, without a real information and computerized base:

i. the ballistic coefficients are not calculated nor estimated, this being the main aerodynamic variable to be considered;
ii. no corrections are indicated to estimate the point of impact;
iii. speed probability densities and impact probability density are not established;
iv. no connection is established with meteorological bases along the path of the projectile;
v. no projectile flight time measurement is provided;
vi. does not measure inclination;
vii. shooting databases are not built in the cloud;
viii. it does not provide any link to ballistic motors;
ix. it does not allow calibrating the height of the sensors in order to minimize the error in the measurement of muzzle velocity.

It is well known that the trajectory of the projectile is influenced, among other factors already mentioned, by the distance to the target, a factor that in both known embodiments is taken as an imprecise and sometimes indeterminate data. In the other cited patent, U.S. Pat. No. 9,709,593, the trajectory of the projectile between sensors is in the open, that is, it does not occur within a protected environment such as a tubular piece, which adds to the problems already mentioned that the muzzle velocity measurement and its trajectory may be exposed to other exogenous factors, aggravating the problem.

The known in the art shooting solution devices (understood as such the adjustments shooting solution devices to the aiming devices in height and drift) are independent devices each one of them only reflecting a single data; as a consequence, they fail to correct or predict point-of-impact (target) corrections, and these individual components cannot work together as a single device providing a ballistic programme providing point-of-impact fire correction or ballistic engine.

Known trajectory correction devices do not have a programme or dedicated backup software enabling comprehensive shooting solutions. There are independent velocity measurement devices in the muzzle of the gun, as demonstrated in the patents cited as background to the present invention; also, inclinometers attached to the weapon, such as bubble levels, are also known to provide independent or single magnitude data; the meteorological data (humidity, wind direction and speed, environmental pressure, etc.) is collected independently by independent known devices hence no known device allows the ballistic coefficient to be acquired in real time at the point of impact.

In short, there is no dedicated software capable of integrating all this data and providing a firearm aiming system correction system prior to firing a subsequent round based on the collected data of impact of a first or previous shot.

Last, ballistic Doppler devices capable of following the trajectory of the projectile up to a distance of 500-700 meters and mainly applied to artillery shooting solutions are known on the market, but apart from its high cost, they cannot be applied in a practical and costs contained way to measure the deviation of the ballistic trajectory of small calibre firearm such as a rifle, while at the same time provide shooting solutions at a distance of up to 5,000 meters. Such result up to date is impossible to achieve with the traditional means known in the art.

OBJECTS OF THE PRESENT INVENTION

The object of the present invention is an integrated system capable of measuring variables and gathering data and parameters to achieve the firing solution, that is, to calculate the corrections to the firearm's aiming system to ensure the impact on the target of as subsequent round, measuring data obtained through a first-round impact on a target, which includes in integral association:

I) A device mechanically linked to the firearm, equipped with sensors capable of measuring the muzzle velocity of the projectile and feeding this data, along with others variables, to a software that stores it and then uses it to solve trajectory the equations thereof;

II) A time-of-flight meter subsystem that allows measuring the time elapsed between the instant the bullet leaves the muzzle and the moment it impacts on the target;

III) Placing anemometers and vanes along the firing trajectory, feeding the microprocessor with wind speed and direction values of in at least three staggered measurements from the firing point to the target;

IV) Establish a subsystem that measures the tilt of the rifle in two axes named "tilt" and "edge";

V) Present a subsystem for speed measurement sensors calibration in order to minimize inherent errors;

VI) Elaborate a proprietary software, for example and without this being a limitation of the invention, running under a Windows, Linux, OS or other software platform commanding the measurement, storing the retrieved data and solving the ballistic equations.

SUMMARY OF THE PRESENT INVENTION

FIREARMS INSTRUMENTING SYSTEM INTEGRATING DISTINCT MEASUREMENTS THAT INFLUENCES THE BALISTIC TRAJECTORY AND ITS CORRESPONDING DATA RETRIEVAL, characterized in that it includes in combination the following interlinked subsystems:

a) a tubular component axially aligned with the bore of the weapon's barrel and linked to its muzzle, said tubular component having inside thereof at least two sensors separated the one from the other, capable of measuring the speed of the projectile as a result of measuring precisely the time it takes for the projectile to travel the distance between sensors, said time measurement being carried out and managed by a microprocessor;

b) a time-of-flight meter subsystem comprising a device named a Transmitter Module, placed in vicinity of the target, with an impact sensor capable of recording the moment the bullet hits the target, and another device called a Receiver Module placed adjacent to the firearm, both devices coordinated to measure the time of flight between the instant the projectile leaves de firearm barrel mouth and the moment it hits the target, said time of flight measurement being performed and managed by said microprocessor;

c) a communication subsystem linked to a meteorological database capable of requesting and receiving in real time meteorological variables representative of the wind speed, its direction, the ambient pressure and temperature, being the request and reception of the meteorological variables carried out by the microprocessor or by the communication facilities of the application;

d) a system software applied to said microprocessor, said software being divided into two parts: a first part contained in the microprocessor, called firmware, which performs speed measurements, inclination measurements, sensor calibration and measurement of flight time, and a second software, called "the application", which consists of an interface with the user, summarizing all the information on a screen, capable of requesting and receiving information from the meteorological database, storing the received data in the cloud, capable of calculating the trajectory of the projectile in real time by means of an integrated ballistic engine;

e) an inclinometer;

f) sensor's calibration.

DETAILED DESCRIPTION OF THE PRESENT INVENTION

In order to exemplify the preferred embodiments of the present invention, the following drawings are attached in support of its description, while these embodiments should be interpreted as one of the many possible constructions of the invention, not being appropriate to assign any limiting value to these drawings and description, including within the scope of this invention all the possible equivalent means; being the breadth and scope of the present invention determined by the first attached claim in the corresponding Claims chapter.

Likewise, in these figures, the same references identify the same and/or equivalent means.

Figure 1:
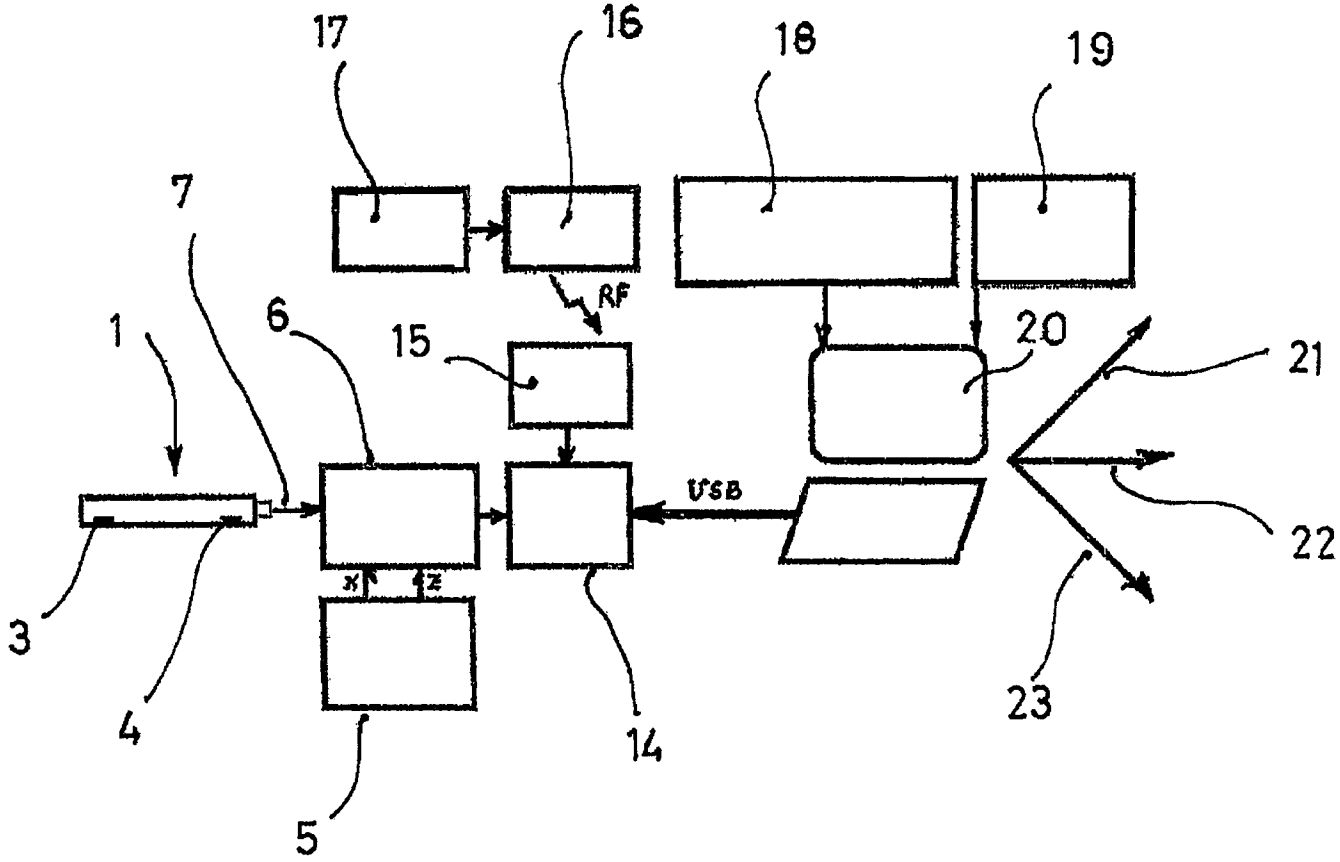
FIG. 1 shows a block diagram of the set of subsystems of a preferred construction mode thereof.

FIG. 1 shows a block diagram of the set of subsystems of a preferred construction mode thereof, without this construction being necessarily exclusive of a mode of integrating said subsystems in a single real-time ballistic motor device.

Figure 2:
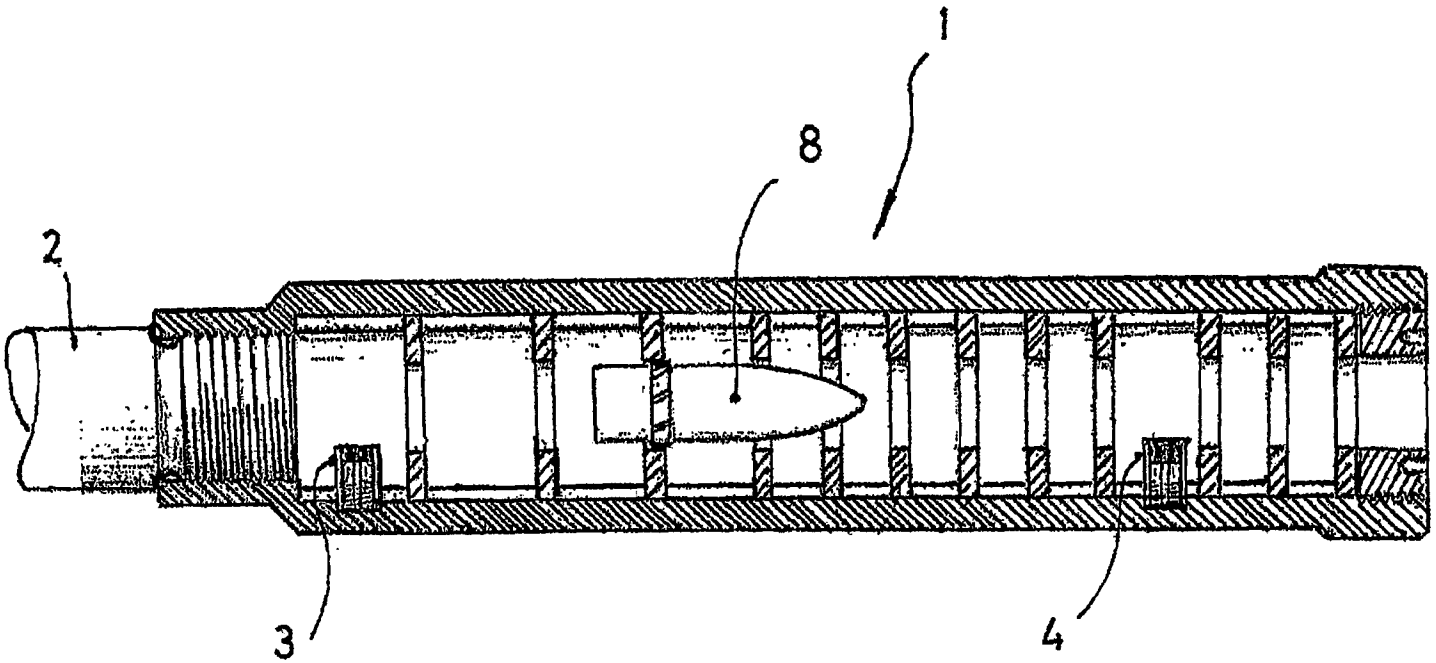
FIG. 2 illustrates a longitudinal diametrical section of one of the possible constructions of the tubular device containing the sensors.

FIG. 2 illustrates a longitudinal diametrical section of one of the possible constructions of the tubular device containing the sensors that in this particular construction consists of a tubular body to be fixed to the muzzle of barrel of the weapon, with a muzzle brake, compensator, flame extinguisher and a reticulated sound suppressor.

Figure 3:
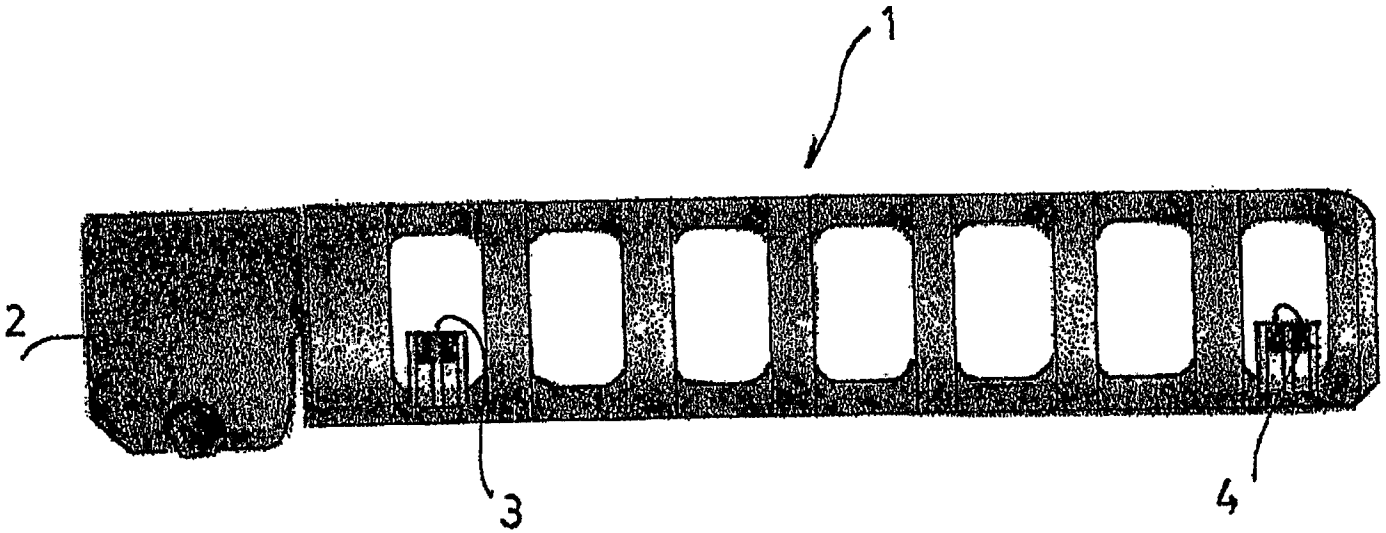
FIG. 3 shows a side view of this tubular structure, mounted or fixed to the muzzle of the firearm using a clamp fixing with fixing screws.

FIG. 3 shows a side view of this tubular structure, mounted or fixed to the muzzle of the firearm using a clamp fixing with fixing screws.

Figure 4:
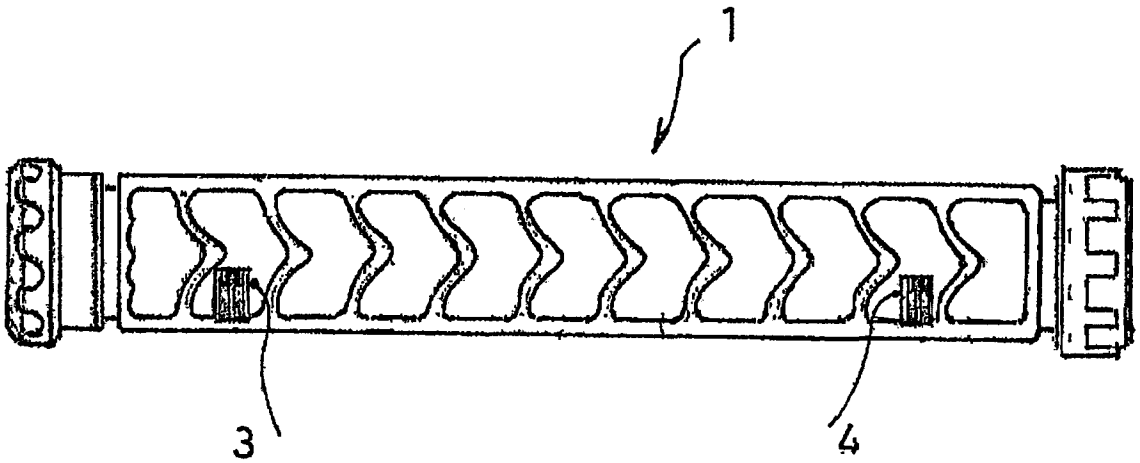
FIG. 4 illustrates a detail of a suppressor body with a threaded frontal cap and the location of the sensors inside the tubular body.

FIG. 4 illustrates a detail of a suppressor body with a threaded frontal cap and the location of the sensors inside the tubular body.

Figure 5:
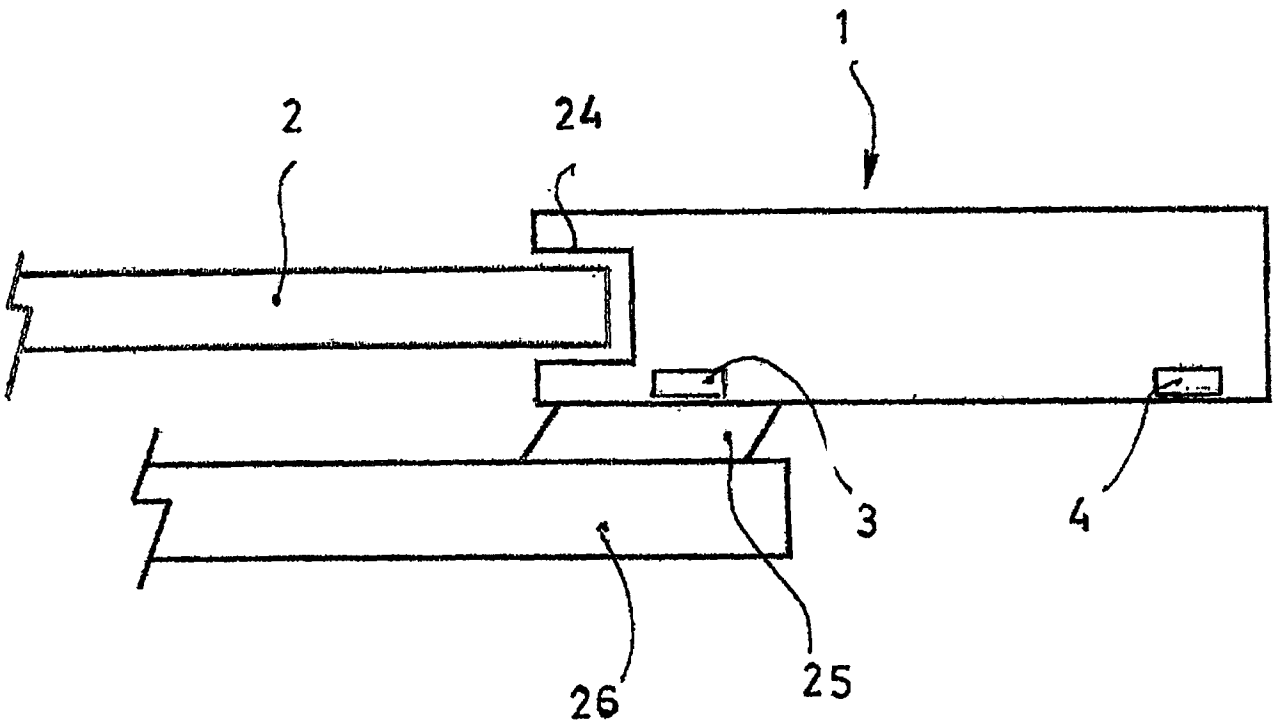
FIG. 5 illustrates another different mode of linking the sensor carrier subsystem to the weapon barrel.

FIG. 5 illustrates another different mode of linking the sensor carrier subsystem to the weapon barrel, consisting of a floating link, that is, not integral with the weapon barrel, and fixed to a secondary component, such as by example linked to an extension of the tripod (not illustrated) supporting the weapon.

Figure 6:
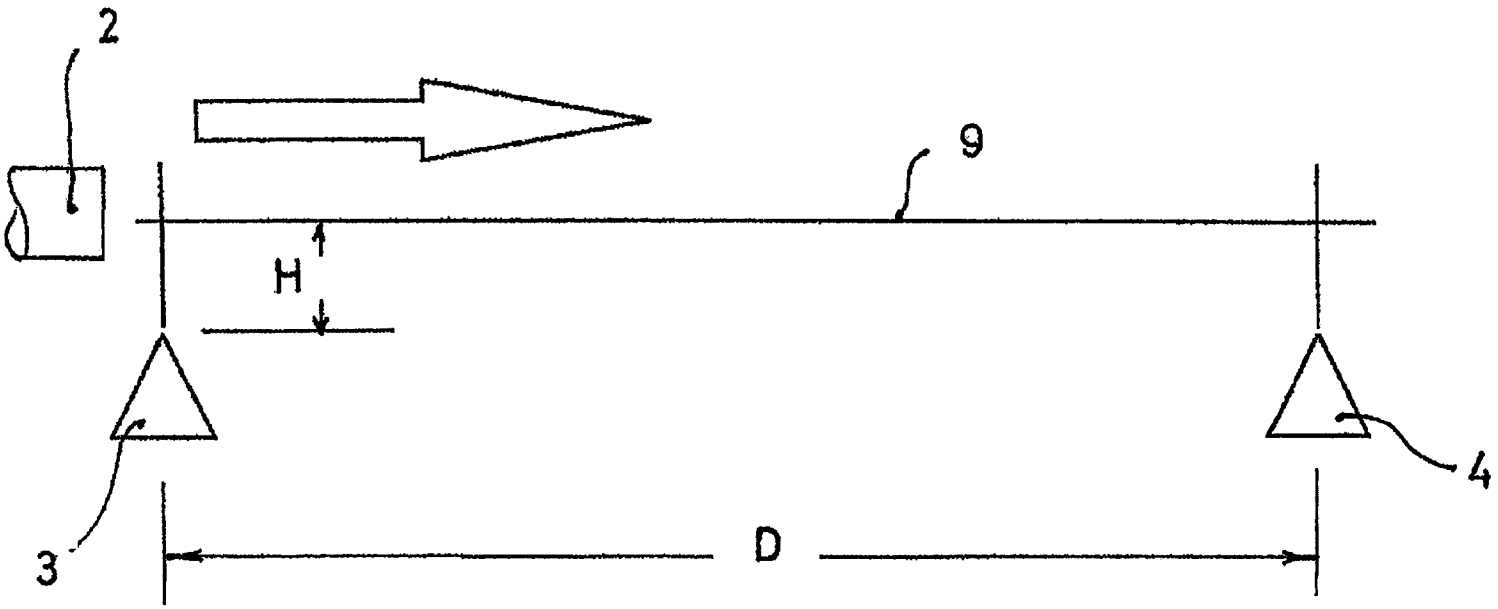
FIG. 6 is an indicative diagram of the data obtained as a result of the passage of the projectile between the two said sensors.

FIG. 6 is an indicative diagram of the data obtained as a result of the passage of the projectile between the two said sensors.

Figure 7:
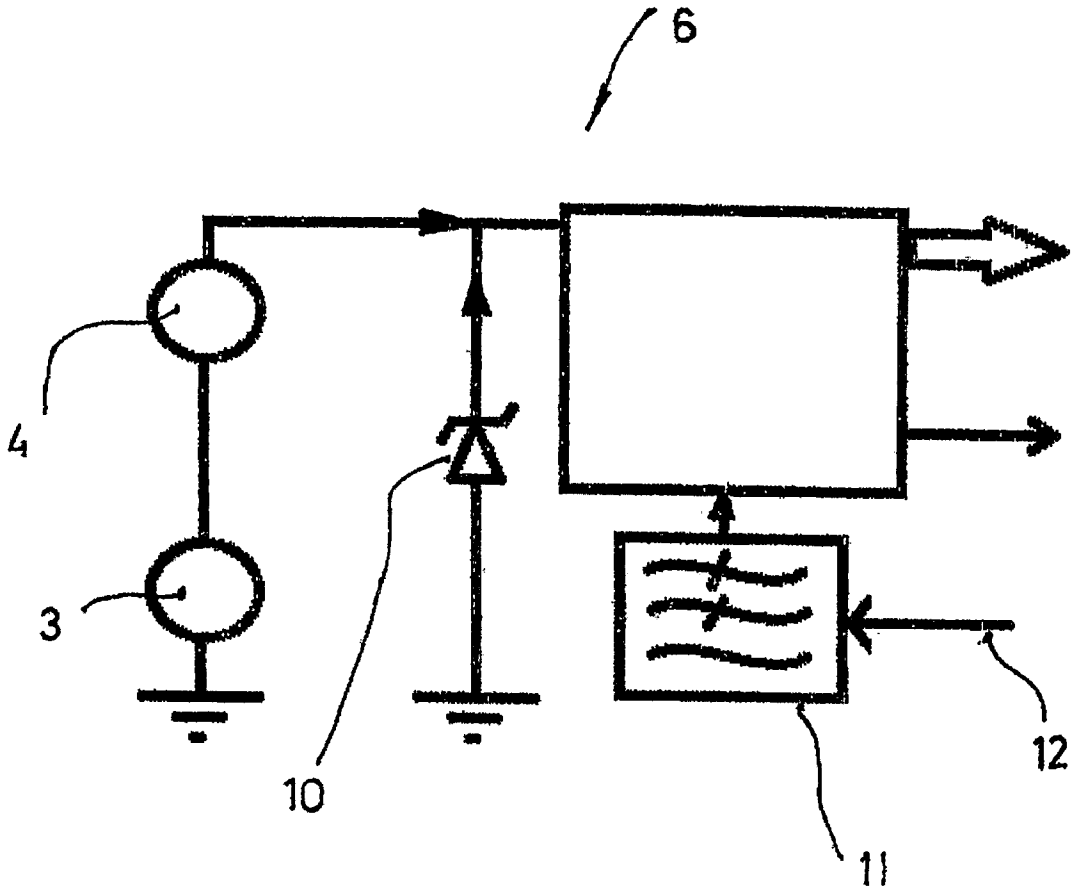
FIG. 7 is a representative block diagram of the electronic subsystem measuring the speed of the projectile and the elaboration of the signal representative of its speed.

FIG. 7 is a representative block diagram of the electronic subsystem measuring the speed of the projectile and the elaboration of the signal representative of its speed.

Figure 8:
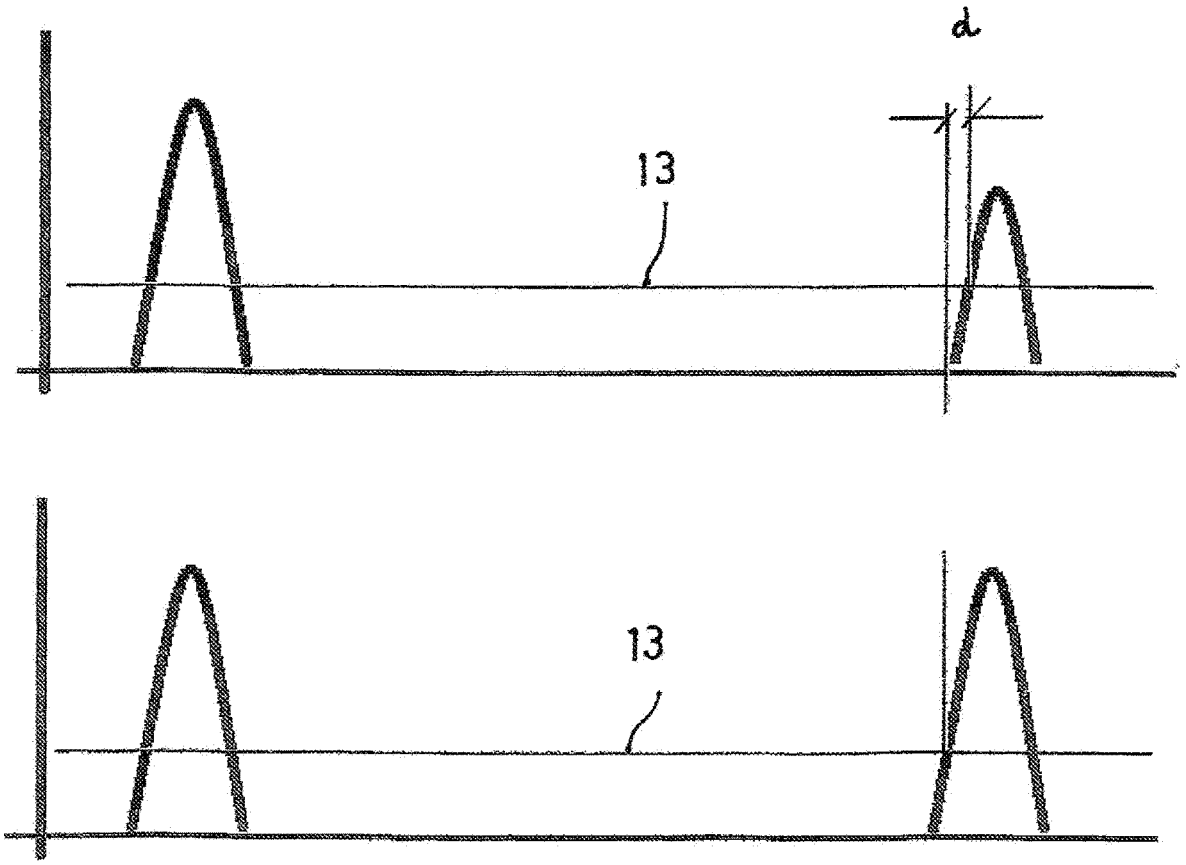
FIG. 8 illustrates the operation of the sensor calibration subsystem.

FIG. 8 illustrates the operation of the sensor calibration subsystem.

Figure 9:
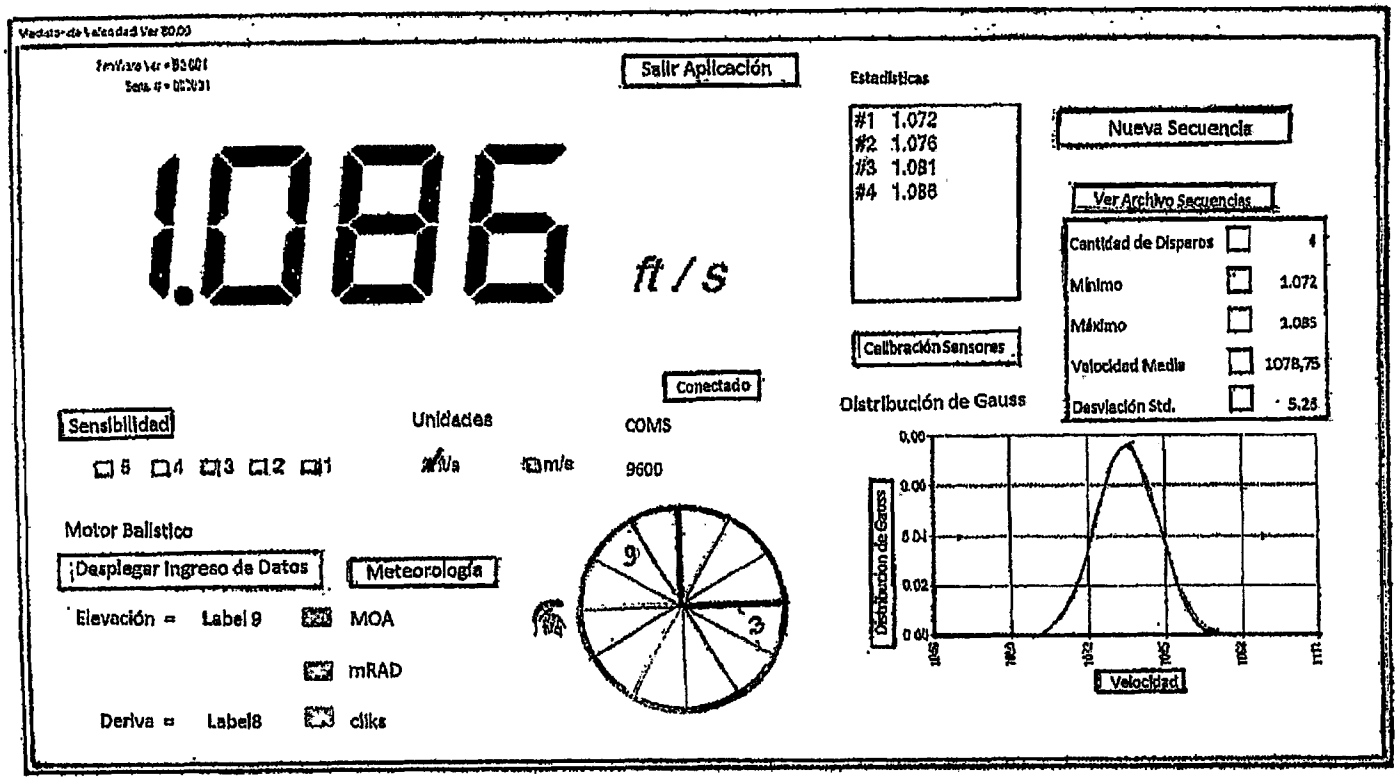
FIG. 9 shows one of the possible screens of the interface with the operator capable of providing, in real time, the firing solution.

FIG. 9 shows one of the possible screens of the interface with the operator capable of providing, in real time, the firing solution, that is, displaying the corrections to the firearm's aiming system to ensure the impact on the target. The set of equations resulting in the shooting solution is called "Ballistic Motor".

Figure 10:
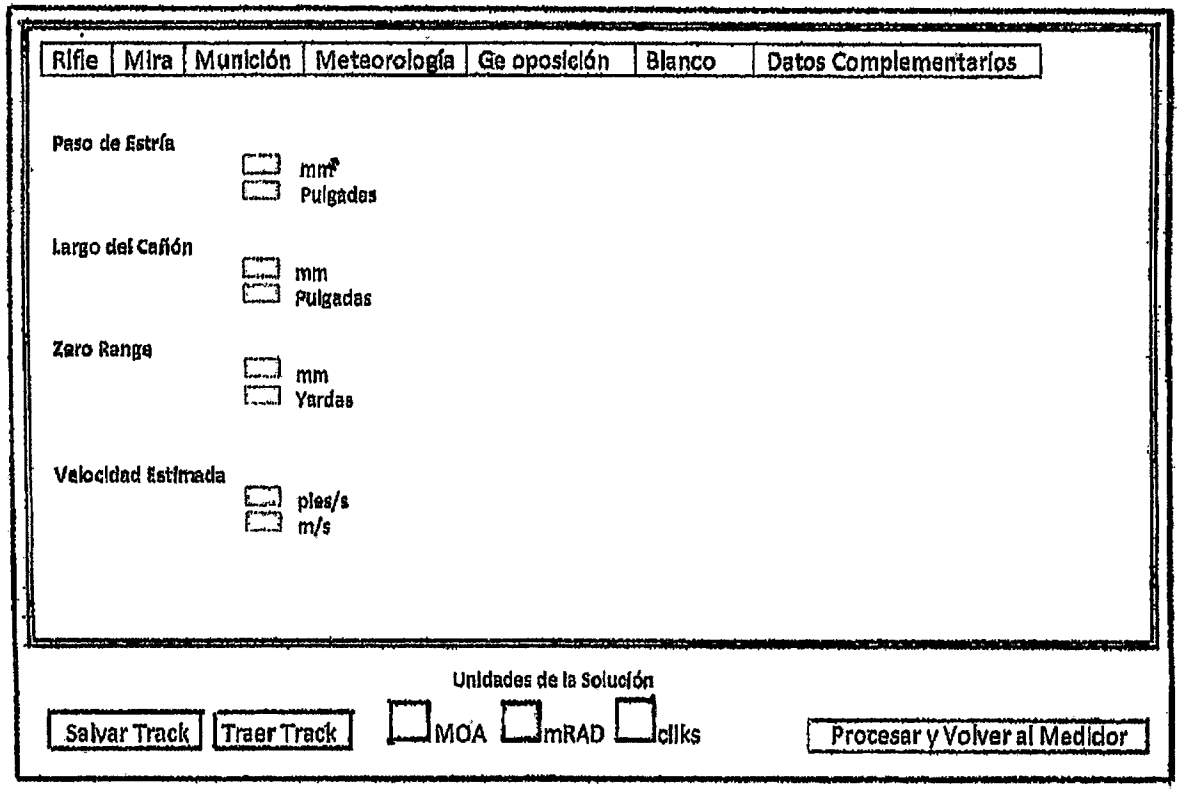
FIG. 10 shows one of the possible Ballistic Engine user interface screens, Block diagram of FIG. 1 depicts one of the possible schematic diagrams leading to the desired result as per this instant patent.

FIG. 10 shows one of the possible Ballistic Engine user interface screens, Block diagram of FIG. 1 depicts one of the possible schematic diagrams leading to the desired result as per this instant patent. In said figure reference (1) indicates a tubular piece, such as for example a flame arrester suppressor tube or compensator, linked to the end or muzzle of the barrel (2) of the weapon.

The connection of the tubular piece (1) to the gun barrel mouth (2) can be achieved basically in two ways. The first involves a fixed connection of the tubular part (1) to said barrel mouth (2) by means of complementary helical threads, sliders, clamps or magnets. Inside the tubular piece (1) two sensors (3, 4) are placed aligned along the trajectory of the projectile and separated or distanced the one from the other. Likewise, preferably inside the tubular structure (1) an inclinometer (5) with two axes -x-, -z- is located.

The second modality for linking the aforementioned tubular part (1) to the weapon is illustrated in FIG. 5. In said figure, the barrel of the weapon (2) is observed wherein the tubular component (2) is not directly linked to the barrel mouth. To this end, the coupling end of (1) conveniently has a recess (24) into which the end of (2) is inserted, without being coupled. The tubular part (1) has at least one extension (25) for connection with, for example, a portion of a bipod (26) or another structure fixed to the weapon. This second fixing modality does not involve connecting the tubular piece directly with the gun's barrel, but rather it leaves same "floating", without its own natural resonance frequency interfering with the gun barrel resonance frequency. In this latter construction, unlike the former one, the barrel does not have any contact with the tubular structure carrying said sensors, hence the tubular structure can be open or closed, integrated with a flame suppressor, compensator, muzzle brake or suppressor.

The signal (7) representative of the speed of the projectile and the signals -x-, -z- emitted by the inclinometer (5) enter a block (6) representing one of the many possible converters signal conditioning circuits A/D.

The principle of measuring the speed of the projectile (8) (See FIG. 2) at the muzzle is based on measuring the time it takes for the projectile to travel a known distance (D) (See FIG. 6) between the two sensors (3, 4). The distance (D) preferably has a magnitude range between 70 mm to 150 mm. These sensors can have different operating principles, for example, by Hall effect, by reluctance variation, by ferro-magnetic effect, by induced currents, etc. The amplitude of the signal (7) generated by the two sensors is proportional to the height "H" measured between the bore line (9) and the active area of the sensor, so that both sensors (3, 4) must be at a height (H) such that its signal has the highest amplitude without saturating the limiting diode (10) (See FIG. 7) of the signal conditioning module (6).

The passage of the projectile (8) over the active surface of a sensor (3, 4) is detected when the voltage generated between its two electrodes, expressed in volts, exceeds a threshold voltage (13) (See Figure FIG. 8). The detector is the subsystem (6), enlarged in FIG. 7, and called "analogic comparator" and it presents a logic state change when the voltage at the sensor output exceeds the threshold. The threshold voltage is established by the low-pass filter (11) and the PWM pulse train (12) entering into (11).

The variable measurements starts with the detection of the projectile (8) in the sensor (3), interrupting its "Supervision" mode performed by the micro-processor (14) changing its state to "Measurement" mode. At the moment the analogic comparator (6) changes its mode state, the microprocessor (14) stores in a memory a first time T1, obtained through its high-precision internal clock, and waits for the projectile (8) to be detected by the following sensor (4). The detection of the passage of the projectile through sensor (4) causes the micro-processor (14) to store a second time T2 in the memory exciting from the "Measurement" mode and entering into a "Transmission" mode. In the internal memory of the micro-processor (14) times T1 and T2 values are recorded in precision of millionths of a second. The timing diagram is shown at FIG. 6.

The microprocessor (14) transmits the recorded information of both time values T1 and T2 to the software under Windows®, Linux®, OS or other known platforms environments through a wired or wireless interface. As will be later analysed in greater detail, the system software, which is preferably working under said Windows®, Linux®, OS or other environment, performs the quotient between the known distance D and the time difference T1-T2, taking advantage of the arithmetic capabilities in floating point processor running Windows®, Linux®, OS or others.

The sensor calibration subsystem is of primary importance for the purposes of the present invention. As already mentioned, the signal generated by the sensors is a function of the height H between the line (9) of the barrel bore and the said sensors active base (See FIG. 6).

Due to imperfections in the coupling of the sensors (3, 4) to the weapon, it may happen that the sensors could be placed at different heights. If this height H Is found, the sensors will detect the passage of the projectile with different amplitudes, resulting in the error in the time measurement values as shown in FIG. 8. For the purposes of the present invention, it is mandatory that both sensors (3, 4) generate signs of equal amplitude detection in order to minimize the error in time measurement. To do this, it uses the digital analogic converter (6) incorporated in the associated electronics illustrated in FIG. 7 and the microprocessor time base (14), which consists of sampling the signal generated by both sensors at regular time intervals using the principle of circular memory, very common in sampling oscilloscopes, to display the signal as a function of time plus the time prior to the trigger threshold known as "pre-trigger time".

An algorithm routine in the microprocessor (14) generates a 256 8-bit vector samples allowing to establishing two very important aspects in the accuracy of the meter: one of them is the absolute amplitude of the signal generated by the sensors and the other, measures the relative amplitude between both sensors. The same routine is in charge of sending the 256 data vector of to the application. Corrections in the coupling devices of the meter to the barrel or external stabilizing structures such as bipods, tripods, monopods, allows increasing the amplitude of the signal and equalize the amplitudes between the sensors in order to minimize the error in the time measurement.

The purpose of the sensor calibration subsystem is to minimize the measurement error by correcting the height of the two sensors so that both read the same amplitude value. It works in conjunction with the "Sensor Calibration" subsystem, providing a graphical representation of the voltage as a function of the time of the signal in both sensors according to FIG. 8. In this figure, in the upper representation the time differential "d" is observed due to the variation of amplitudes between one sensor and the other, and in the lower FIG. 8 the times correction when the amplitudes of both sensors are equal.

The impact detection and time-of-flight measurement subsystem consists of two modules linked by RF in the free-use band of 2.4 GHz or 433 MHz. A module called Receiver Module (15) receives a message from a module called Impact Detection Transmitter Module (16) when it detects the impact of a projectile on the target (17). Impact detection is preferably, but not mandatory, by means of a piezoelectric ceramic fixed to the metal surface of the target. This sensor is located in the centre of gravity of the target so that the detection distance with said target is as short as possible.

The measurement principle is based on the difference in speed between the projectile or bullet and the electromagnetic waves that make up the RF radio frequency, with the ratio of the speed of light to the speed of the bullet being 300,000 times. The detection signal travels from the transmitter module (16) to the receiver module (15) at the speed of Hertz waves, which is approximately 300,000 km/s.

The meter detects the passage of a projectile over the sensor (3). At that moment, it starts a stopwatch with 125 ns resolution ($1/8{,}000{,}000$ s). The projectile or bullet travels from the weapon (2) firing towards the target (17) (remote) at a typical speed of 1 km/s.

The receiver module (15) is waiting for the transmitter module (16) to notify the detection of the impact of the projectile on the target (17). The receiver module (15) receives the message from the transmitter module (16) and stops the stopwatch which saves the time of flight magnitude, and by subtracting the fixed and measurable fractions of time, which are those associated with the time it takes for the sound from the impact zone on the target's material (17) until reaching the piezoelectric sensor (5 km/s on steel, 5 times faster than the bullet). The chronometer gives the microprocessor (14) the value of the time of flight so that it sends it to the application under Windows, Linus, OS or other environments through the wired or wireless interface.

The receiver module (15) is controlled by the microprocessor (14).

The inclinometer subsystem (5) with its two axes -x-, -z- provides other variables that must be controlled to ensure a precise and predictable shot. There are two angles linked to the position of the rifle against the gravity acceleration vector. The first of these angles is the tilt, which is defined as the angle between the barrel bore and the perpendicular to gravity. The second of these angles is called "canting", it is defined as the angle between the plane of the perpendicular to the inclination and gravity.

Preferably, the system incorporates an inclinometer (5) with two axes, -x-, -z-belonging to a MEMS (Micro Electro Mechanical System). The integrated semiconductor is linked to the printed circuit board housing the main electronics. The welding process of the MEMS to the plate ensures the total horizontality of the inclinometer with respect to the barrel bore.

The -x- axis measures the inclination and the -z- axis the edging. The analogic magnitudes are converted to data by the analogic to digital converter contained in the microprocessor as shown in the block diagram of FIG. 1. They are sent to the software under, for instance, Windows environment through the USB interface. The angle values are sent by the hardware unit at regular time intervals.

The microprocessor subsystem (14) provides data manage, the use of all the resources usage and with a clock frequency calibrated at 20 MHz. The internal modules of communication send the data collected by wired or wireless interface.B to the application under Windows environment. The meteorological bases (18) and the Wi-Fi cameras (19) send their data to the Windows environment (20), and from which the data is sent to the cloud storage (21), or to the reporting printer (22) or to a remote desktop (23), or any combination of such or any other known peripherals.

The system of the present invention incorporates a subsystem to communicate with the meteorological bases of the Kestrel, GeoTek, or similar type or of own manufacture, taking advantage of the BlueTooth communication contained in the tubular structure.

The integrated system for the instrumentation of firearms of the invention needs to know the meteorological variables in order to allow the integrated ballistic engine to solve the trajectory equation. To this end, the system connects via Bluetooth or WiFi communication from the PC with the meteorological bases that have been arranged in the path of the projectile. The number of bases can be variable according to the amount of data the motor can handle and the distance from the target or the PC running the application.

The meteorological bases measure the following variables: relative humidity, atmospheric pressure, temperature, magnitude and direction of the wind. These last two magnitudes are generally measured by the vane-anemometer assembly, which can be mechanical, 2D ultrasonic, or 3D ultrasonic.

The well-known meteorological base provided under the Trademark Kestrel model 4500 is consulted by bluetooth delivers all the meteorological variables in a single data vector.

The system of the present invention links its hardware with its software part by means of a wired or wireless interface link. By means of an integrated adapter and an automatically downloadable driver, the Windows, Linux, OS or other operating system detects the integrated system for the instrumentation of firearms of the invention and assigns it a virtual port, leaving it operative until the application under Windows environment, Linux, OS or others take control of the port.

The system software comprises two very different codes, the first one is the microprocessor resident programme, written in a compatible language, very compact and efficient, in charge of detecting the sensors, carrying out the muzzle velocity measurement, measuring and converting the data delivered by the two-axis inclinometer, managing all impact detection and flight time measurement, from which the ballistic coefficient is derived, and perform sensor's calibration.

The user interface presents in a single page the information necessary to analyse the performance of the shot in real time. On this main screen it is observed the muzzle velocity, all the statistical analysis of the shots, the angles of inclination and if the system is linked to a ballistic motor, it also gives the shooting solution in terms of the correction to be made to the aiming device coupled to the firearm (e.g., a scope) to ensure the impact of the projectile on the target.

The application under Windows environment runs using the "Cores" and "Threads" of the processor to optimize the attention of the resources and the operations in floating point. Take advantage of the HD resolution of the screen to display the greatest amount of information in a useful and orderly way. The application also takes advantage of all the connectivity resources offered by the PC that runs it, the WiFi connection, BlueTooth, the Ethernet port, the infrared port and others, to connect cameras, rangefinders, GPS's, etc.

Regarding the areas of the user interface, it is given a statistical speed parameters table. This table gathers the statistical information of the variable measured with the system, providing the maximum, minimum, and average values and, above all, the standard variation, known as SD. All statistical values are recalculated for each shot, taking muzzle velocity as the main variable.

The curve of velocity probability density is the velocity probability distribution curve, known as the Gaussian probability density and offer an immediate estimate of the performance of the rifle/ammunition set. It allows inferring the area probability density of impact.

The system of the invention has an integrated ballistic motor, which can be summarized on the screen according to FIG. 10, and by "ballistic motor" it is being understood as the set of equations to which variables such as: projectile speed, ballistic coefficient of the projectile, the atmospheric date, the distance to the target, the inclination, data those linked to the weapon, etc. will result in the "Shooting Solution", as the prevailing data and final result of this invention, which is applied by means of the necessary corrections to the elevation and drift that must be given to the aiming system, whether they are optical, orthoptic, electronic, mechanical or of any kind, so that the following shot is accurate and precise on target.

The interface with the ballistic motor, either its own or external, is a vector of measured and stored data. Each time a shot is recorded, the system delivers the data vector to the ballistic engine to calculate the new shot solution. The vector in turn is stored with date and time in the non-volatile memory of the PC or sent to a cloud service to be later analysed.

All the information recorded during the shots is saved on the local hard drive and in the cloud in two formats, PDF and TXT, the latter allows data to be migrated to more general bases.

Non-volatile memory resources contained in the PC running under Windows, Linux, OS or another environment are used.

The invention claimed is:

1. A firearm instrumenting system integrating measurements that influence a ballistic trajectory and a data retrieval, the firearm instrument system comprising:

a) a tubular component axially aligned with the bore of a weapon's barrel and linked to a muzzle, said tubular component having inside thereof at least two sensors separated the one from the other, the sensors measure a speed of the projectile as a result of measuring precisely the time it takes for the projectile to travel the distance between sensors, said time measurement being carried out and managed by a microprocessor;

b) a time-of-flight meter subsystem comprising a device named a Transmitter Module, placed in vicinity of the target, with an impact sensor to record a moment the bullet hits a target, and a receiver module placed adjacent to the firearm, the impact sensor and the receiver module coordinated to measure the time of flight between the instant the projectile leaves de firearm barrel mouth and the moment it hits the target, said time of flight measurement being performed and managed by said microprocessor;

c) a communication subsystem linked to a meteorological database capable of requesting and receiving in real time meteorological variables representative of the wind speed, its direction, the ambient pressure and temperature, being the request and reception of the meteorological variables carried out by the microprocessor or by the communication facilities of the application;

d) a system software applied to said microprocessor, said software being divided into a firmware contained in the microprocessor, which performs speed measurements, inclination measurements, sensor calibration and measurement of flight time, and a an application software, which includes an interface with the user, summarizing all the information on a screen, capable of requesting and receiving information from the meteorological database, storing the received data in the cloud, capable of calculating the trajectory of the projectile in real time by means of an integrated ballistic engine;

e) an inclinometer;

f) calibration sensors.

2. The firearm system according to claim 1, wherein said sensors are chose between the following sensors: Hall effect sensors, sensors by variation of reluctance, by ferro-magnetic effect, by induced currents, being said sensors separated the one form the other at a distance between 70 mm to 150 mm.

3. The firearm instrumenting system according to claim 1, wherein said tubular piece is fixed to the firearm muzzle by means of a fitting connection chosen between complementary helical threads, linkage means, clamp or magnets.

4. The firearm instrumenting system according to claim 1, wherein the said tubular piece is attached the firearm muzzle by means of a floating coupling, being said the tubular piece being linked to a structure integral with the weapon, without the gun's barrel having any contact with said tubular piece carrying said sensors.

5. The firearm instrumenting system according to claim 1, further including a calibration subsystem for said sensors which have their vertical height adjusted individually, the signal generated by the sensors being a function of the height between the barrel bore line and the activation base of each sensor, until determining that both sensors are generating detection signals of equal amplitude by sampling the signal generated by both sensors at regular time intervals, using for this purpose a digital analogic converter and the high-precision time base, being both functions contained in the microprocessor.

6. The firearm instrumenting system according to claim 1, the impact detection and flight time measurement subsystem, consists of a receiver module capable of receiving the signal from a transmitter module with impact detection, linked by RF; the aforementioned transmitter module with impact detection receives the impact signal from the sensor coupled to the surface of the target, all functions being controlled by the microprocessor.

7. The firearm instrumenting system according to claim 1, wherein the two-axis inclinometer subsystem -x-, -z-, whose integrated semiconductor is linked to the printed circuit board containing the main electronics, wherein axis -x- measures the inclination and axis -z- measures the edge issuing analogic magnitudes which are converted to digital data by the analogic to digital converter contained in the microprocessor; these signals are fed to the micro-processor software under Windows, Linux, OS or other platforms, through the wired or wireless interface.

8. The firearm instrumenting system according to claim 1, wherein the communication subsystem includes meteorological bases connected through BlueTooth, Ethernet, Serial, WiFi, RF, communication connection contained in the tubular structure or in the PC that runs the application, measuring said bases meteorological variables such as relative humidity, atmospheric pressure, temperature, altitude, wind speed and direction.

9. The firearm instrumenting system according to claim 1, wherein the hardware is linked to the software by means of a USB communication, an adapter integrated circuit and an automatically downloadable driver, assigning the operating system Windows, Linux, OS or others a virtual port leaving it operative until the application under Windows, Linux, OS or other environment takes control of the port; the system software being constituted by two different codes, the first of them constituting the resident program in the microprocessor, capable of measuring the time it takes for the projectile to travel the distance that separates the sensors, having an interface with the user presenting in a single page the necessary real time information, the inclination angles, the travel speed of the round at the muzzle, a table of statistical parameters of the speed with maximum, minimum, average values and the SD standard variation, being all the statistical values recalculated at each shot and compiled into a Gaussian curve, whose velocity probability density is representative of the impact area probability.

* * * * *